United States Patent [19]

Roberts

[11] 4,280,678

[45] Jul. 28, 1981

[54] BLEED VALVE

[75] Inventor: Ivor J. Roberts, St. Lambert, Canada

[73] Assignee: Pratt & Whitney Aircraft of Canada, Limited, Longueuil, Canada

[21] Appl. No.: 964,485

[22] Filed: Nov. 29, 1978

[51] Int. Cl.[3] ..... F16K 31/126

[52] U.S. Cl. ..... 251/61.2; 251/210; 251/155

[58] Field of Search ..... 251/210, 61.2, 155; 137/533.27, 533.31

[56] References Cited

U.S. PATENT DOCUMENTS

| | | | |
|---|---|---|---|
| 177,925 | 5/1876 | Crane | 251/210 |
| 2,214,863 | 9/1940 | Schultheiss | 251/120 |
| 2,403,751 | 7/1946 | Palmer | 251/210 X |
| 3,360,189 | 12/1967 | Cook | 415/168 |

*Primary Examiner*—Arnold Rosenthal

*Attorney, Agent, or Firm*—Schwartz, Jeffery, Schwaab, Mack, Blumenthal & Koch

[57] ABSTRACT

An improved bleed valve for the compressor of a gas turbine engine comprises a port communicating with the intermediate section of the compressor. An annular valve seat surrounds the port, the valve seat having a radial surface terminating in an outer peripheral circular rim. A piston is provided having a flat radial surface and adapted to close on the valve seat, the piston having a peripheral inner cylindrical surface having a diameter corresponding to the outer circular rim of the valve seat. The axial component of the piston inner peripheral surface is chosen such as to be sufficient to close the so-formed nozzle just prior to the piston radial surface closing on the valve seat to prevent chattering of the piston caused by diffuser effect.

2 Claims, 3 Drawing Figures

BLEED VALVE

The invention herein described was made in the course of or under a contract or sub-contract thereunder (or grant) with the United States Department of the Navy.

BACKGROUND OF THE INVENTION

1. Field of the Invention

The present invention relates to a bleed arrangement for gas turbine engines.

2. Description of the Prior Art

More specifically, the bleed arrangement is of the type described in U.S. Pat. No. 3,360,189, issued Dec. 26, 1967, D. L. Cook, inventor. In that patent, a piston having opposed faces is subjected to air pressure on opposed faces thereof. One of the piston faces which is flat is adapted to cooperate with a valve seat peripherally of an exit port intermediate the compressor. The piston is meant to throttle the bleed air from the compressor.

In present bleed valve configurations as well as those described in U.S. Pat. No. 3,360,189, there is provided a flat radially extending valve seat adapted to receive flat radial piston surfaces, and as the piston is closing on the valve seat, a peculiar phenomenon occurs. The piston begins to chatter or vibrate, thus causing a loss of bleed control. The space between the piston and the valve seat represents a nozzle. According to Technische Strömungslehre, Von Brand Eck, page 28, the phenomenon is described as being based on the fact that the inside diameter of the so-formed nozzle is of a smaller diameter than the outside diameter; therefore, the nozzle area is increasing diametrically outwardly, thus creating a diffuser passage. Since the outside pressure is atmospheric, then the pressure inwardly of the nozzle is below atmospheric creating suction areas, thereby rendering the piston unstable just before it is completely closed with the valve seat.

SUMMARY OF THE INVENTION

A construction in accordance with the present invention comprises an improved bleed valve comprising a port, an annular valve seat surrounding the port, the valve seat having a radial surface terminating in an outer peripheral circular rim, a piston having a flat, radial surface and adapted to close on said valve seat, the piston having a peripheral, inner, cylindrical surface having a diameter corresponding to the outer circular rim of the valve seat, the axial component of said piston inner peripheral surface being chosen such as to be sufficient to close the so-formed nozzle just prior to the piston radial surface closing on said valve seat to prevent chattering of the piston caused by diffuser effect.

The axial extent of the inner surface is insufficient to prevent sufficient bleeding as the piston is opened and closed in response to an increase in the rate of rotation of the engine by gradually moving towards the seat, thus reducing the effective bleed exit port.

BRIEF DESCRIPTION OF THE DRAWINGS

Having thus generally described the nature of the invention, reference will now be made to the accompanying drawings, showing by way of illustration, a preferred embodiment thereof, and in which.

DESCRIPTION OF THE PREFERRED EMBODIMENTS

Figure 1:
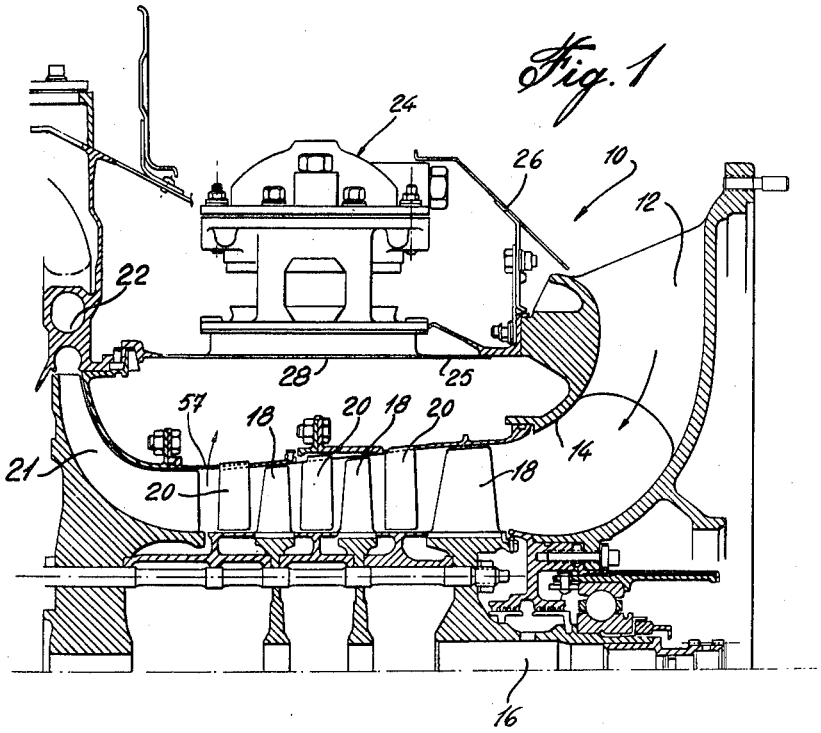
FIG. 1 is a fragmentary cross-sectional view of a portion of a typical gas turbine engine.

Referring now to the drawings, there is shown a compressor assembly 10 of a typical gas turbine engine including an air inlet casing 12 and a shroud 14. The compressor assembly is, of course, annular, and the details of the compressor shown in FIG. 1 are symmetrical about the shaft 16. The compressor per se includes rotor blades 18 interspaced by stator vanes 20 and an impeller 21 located at the downstream end of the compressor. Finally, the air flow enters the centrifugal pipe diffuser 22.

Figure 2:
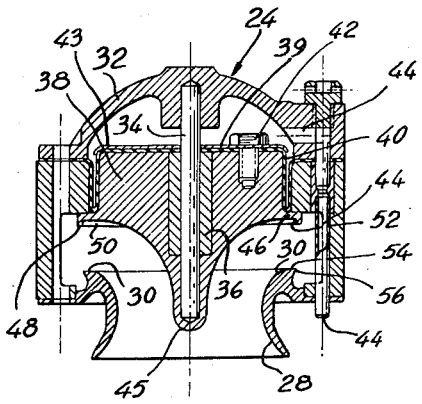
FIG. 2 is a vertical cross-section of a detail shown in FIG. 1.
Figure 3:
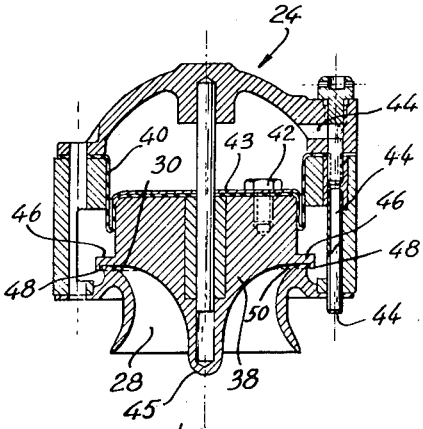
FIG. 3 is a vertical cross-section, similar to FIG. 2, but showing the apparatus of FIG. 2 in a different operative position.

An air bleed valve assembly 24 is provided on a compressor casing wall 25 and defines, as shown in FIGS. 2 and 3, a port 28. The bleed valve assembly 24 includes a valve seat 30 having convex walls terminating in a narrow flat annular wall extending in a radial plane and identified by the reference numeral 54. The shape of the port is determined by air flow. The valve assembly 24 has a cap 32 to which is fixed a shaft 34. A piston 38 is provided and is guided on the shaft 34 by means of a sleeve 36. A diaphragm 40 is fixed to the top surface of the piston at 39 and to the peripheral walls of the bleed valve 24. The diaphragm 40 is fixed to the piston by means of a nut 42 and a retaining plate 43. A passage 44 is defined in the wall of the bleed valve and communicates with the chamber defined between the piston top surface 39 and the cap 32. The piston has an extended nose 45 adapted to allow for a relatively longer shaft 34 so that the piston is still relatively stable when it is downwardly extended as shown in FIG. 3. The piston has an annular flange 46 extending in a radial plane and defining flat surfaces 50. The flange 46 terminates in a downwardly extending lip of rectangular cross-section and defines an inner cylindrical surface 52 adapted to cooperate with the circular rim 56 of the valve seat 30.

The operation of the bleed valve is similar to that described in U.S. Pat. No. 3,360,189 in that the piston 38 responds to differential pressure between the valve seat side of the piston and the side of the surface 39. If the bleed air comes from the intermediate section of the compressor, then the air passes through the passage 44 into the chamber 49, and the piston 38 will be in the position shown in FIG. 2, allowing air from the intermediate portion of the compressor to bleed out to the atmosphere. If the air passing through the passage 44 into the chamber 49 is increased in pressure, as will happen when the rate of rotation of the engine increases, the piston will move downwardly on the shaft 34 until the surfaces 50 of the piston come into close contact with the flat surfaces 54 of the valve seat 30. Where, in a conventional bleed valve, the piston would be subject to the phenomenon described above, the cylindrical inner surface 52 of the lip 48 will block off the passage still existing between the flat surfaces 50 and 54, thereby preventing the chattering phenomenon from occurring.

The axial component of the surface 56, or at least the height of that surface, is chosen such that it will block off the passage in a guillotine fashion before the piston begins to chatter. This height or axial component can vary depending on the dimensions and characteristics of the particular bleed arrangement of an engine.

I claim:

1. A bleed valve to be located at an intermediate portion of a compressor in a gas turbine engine, the bleed valve comprising: a port; an annular valve seat surrounding the port, the valve seat having a radial surface terminating in an outer peripheral circular rim; a sliding piston having two opposed working surfaces, one working surface including a flat radial surface and adapted to close on said valve seat, and the other working surface being flat and being in a chamber in which air under pressure is fed from a second flow path by way of a port opening into said chamber; means for preventing the piston from chattering just prior to closing of the piston on the valve seat, said preventing means including a peripheral inner cylindrical surface on said flat radial surface of said piston, said piston inner peripheral surface having a diameter corresponding to the outer circular rim of the valve seat, the axial component of said piston inner peripheral surface being chosen such as to cut off the bleeding of air just prior to the flat radial surface of the piston closing on the valve seat.

2. An apparatus as defined in claim 1, wherein closing of the piston tends to form between the piston and port a diffuser nozzle which creates a diffuser effect and wherein said cylindrical inner peripheral surface of the piston is defined by a peripheral lip on the piston, the axial component of the cylindrical inner surface of the lip being chosen such that it is sufficient to close the so-formed diffuser nozzle just prior to the piston radial surface closing on the valve seat to prevent chattering of the piston caused by diffuser effect but is insufficient to prevent sufficient bleeding as the piston is opened and closed in response to an increase in the rate of rotation of the engine by gradually moving towards the seat.

* * * * *